US005259526A

United States Patent [19]

Stolzman

[11] Patent Number: 5,259,526

[45] Date of Patent: Nov. 9, 1993

[54] RIBBED COVER

[76] Inventor: Michael D. Stolzman, 1188 Old Colony Rd., Lake Forest, Ill. 60045

[21] Appl. No.: 26,263

[22] Filed: Mar. 4, 1993

Related U.S. Application Data

[63] Continuation of Ser. No. 863,107, Apr. 3, 1992, abandoned.

[51] Int. Cl.[5] ..... B65D 43/06

[52] U.S. Cl. ..... 220/355; 220/319; 206/508

[58] Field of Search ..... 220/306, 307, 308, 319, 220/320, 321, 355, 380; 206/508, 509

[56] References Cited

U.S. PATENT DOCUMENTS

| | | | |
|---|---|---|---|
| 4,296,871 | 10/1981 | Andersson | 220/306 |
| 4,356,930 | 11/1982 | Roper | 220/306 |
| 4,457,447 | 7/1984 | Kirkis | 220/306 |
| 4,500,010 | 2/1985 | Schutz | 220/320 |
| 4,512,493 | 4/1985 | Von Holdt | 220/306 |
| 4,805,798 | 2/1989 | Stolzman | 220/315 |
| 4,881,658 | 11/1989 | Van Cucha | 220/306 |

*Primary Examiner*—Allan N. Shoap

*Attorney, Agent, or Firm*—Wood, Phillips, VanSanten, Hoffman & Ertel

[57] ABSTRACT

A closure is disclosed for use with a tubular container having an open end with a cylindrical connecting bead at the open end. The closure includes a circular wall and a peripheral connecting flange surrounding a peripheral edge of the connecting bead so that the circular wall closes the open end of the container. First and second coaxial reinforcement ribs depend downward from the circular wall to provide suitable reinforcement while eliminating crevices on the circular wall.

14 Claims, 1 Drawing Sheet

RIBBED COVER

This application is a continuation of application Ser. No. 07/863,107, filed Apr. 3, 1992, abandoned.

FIELD OF THE INVENTION

This invention relates to containers and, more particularly, to a closure for use with a container.

BACKGROUND OF THE INVENTION

In one form of conventional shipping and storage container, a tubular side wall is formed of fibrous material. Conventionally, a cylindrical connecting bead is connected at an open end of the container for securing a closure wall thereacross. The connecting bead may be a metal securing ring rolled onto the side wall or a plastic connecting ring molded directly to or otherwise adhered to the side wall. Alternatively, the side wall may be of molded plastic construction with an integral connecting bead.

The conventional container includes a removable closure for closing the open end of the tubular side wall. A typical closure includes a central circular wall with a peripheral connecting flange receivable on the connecting bead so that the circular wall closes the open end of the container. While such a container may be used for storage purposes, often the containers must be shipped, such as by truck. Various standards organizations require that a closure for use on a container as described have suitable reinforcement to provide improved impact resistance. Typically, such a closure includes circular channels formed in the circular wall providing a wave like appearance. One problem with such a closure is that debris or other material can collect in the channels. Also, the channels can make stacking more difficult.

The invention disclosed herein is intended to solve one or more of the problems discussed above.

SUMMARY OF THE INVENTION

In accordance with the invention there is provided a closure for use with a tubular container including a flat circular wall.

Broadly, there is disclosed herein a closure for use with a tubular container having an open end with a cylindrical connecting bead at the open end. The closure comprises a circular wall and a peripheral connecting flange surrounding a peripheral edge of the circular wall and receivable on the connecting bead so that the circular wall closes the open end of the container, in use. A first cylindrical reinforcement rib depends downwardly from the circular wall and has a diameter less than the diameter of the connecting bead. A second cylindrical reinforcement rib depends downwardly from the circular wall and has a diameter less than the diameter of the first cylindrical reinforcement rib.

It is a feature of the invention that the first and second reinforcement ribs are coaxially.

It is another feature of the invention that the first and second reinforcement ribs are of different heights.

It is still another feature of the invention that the first reinforcement rib has a greater height than the second reinforcement rib.

It is still a further feature of the invention that the outer diameter of the first reinforcement rib is slightly less than an inner diameter of the connecting bead to support the bead.

It is still an additional feature of the invention that the circular wall is substantially planar.

It is disclosed in accordance with another aspect of the invention that the closure comprises a unitary wall element of molded synthetic resin.

Further features and advantages of the invention will readily be apparent from the specification and the from the drawings.

DESCRIPTION OF THE INVENTION

Figure 1:
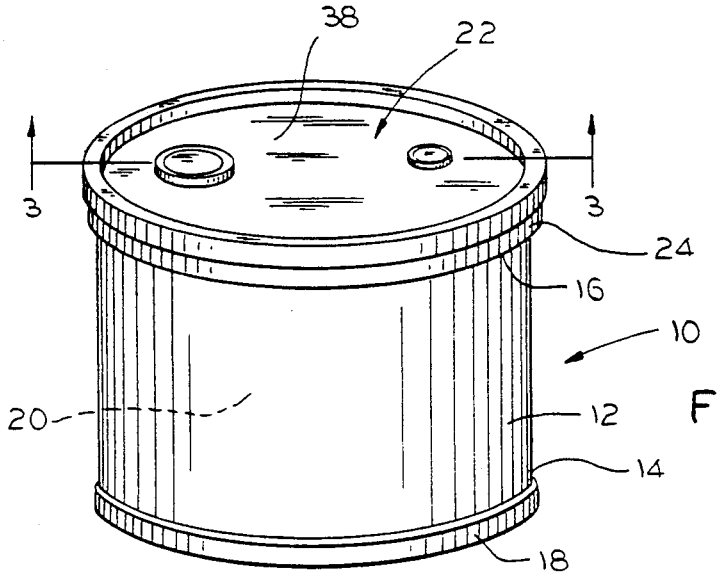
FIG. 1 is a perspective view of a container including a closure according to the invention.
Figure 2:
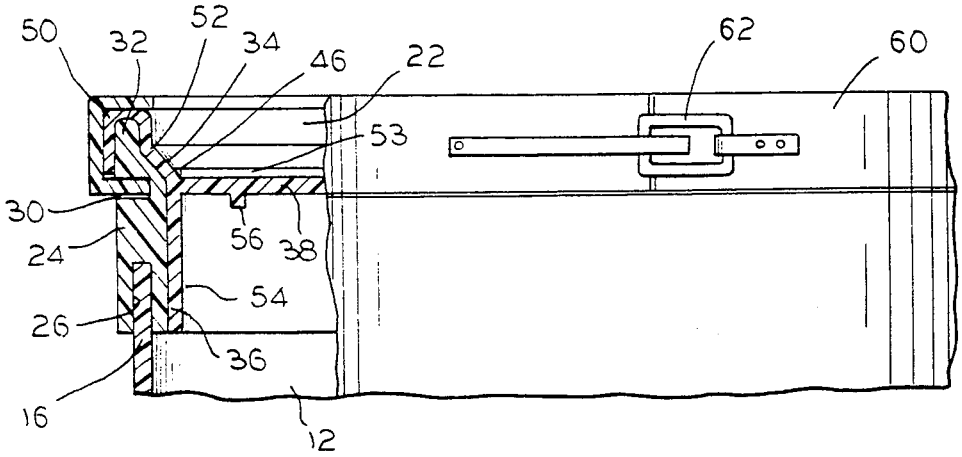
FIG. 2 is a partial elevational sectional view of the container of FIG. 1.
Figure 3:
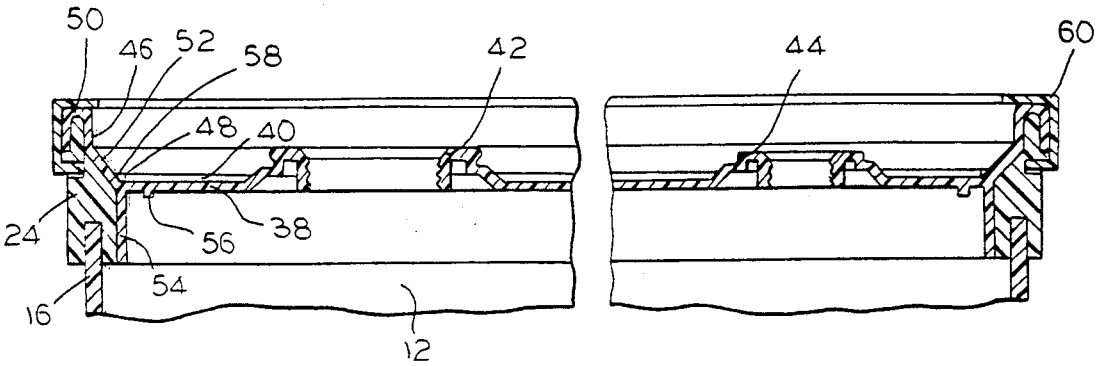
FIG. 3 is a sectional view taken along the line 3—3 of FIG. 1.

In the illustrated embodiment of the invention, as disclosed in FIGS. 1-3, a container generally designated 10 includes a fibrous tubular side wall 12. The side wall 12 is formed in a right cylindrical configuration, it being understood that the side wall 12 may define other suitable configurations, such as square, oval, etc.

The side wall 12 has a lower end portion 14 and an upper end portion 16. The lower end 14 is closed by a closure 18 fixedly secured to the side wall as seen in FIG. 1. The side wall 12 and lower closure 18 define an internal storage space 20 normally open at the upper end 16. The open upper end 16 is selectively closed by a second closure 22 removably secured to a connecting ring or bead 24 fixedly secured to the side wall upper end 16.

In the illustrated embodiment of the invention, the connecting ring 24 comprises a chime molded of a suitable synthetic resin, such as high density polyethylene. The chime 24 includes an annular channel 26 receiving the side wall upper end 16. The chime 24 may be secured to the side wall 12 as with an adhesive or by being molded integrally therewith as disclosed in my U.S. Pat. No. 4,805,798.

The connecting ring 24 further includes a peripheral, radially outwardly opening annular recess 30. The connecting ring 24 is narrower at an upper distal portion 32 above the recess 30. The connecting ring 24 on the inside widens at angled portion 34 to an inner cylindrical portion 36 of a select inner diameter.

The closure 22 comprises a unitary wall element of molded synthetic resin, such as high density polyethylene. The closure 22 includes a central circular wall 38 which is generally planar to define a flat upper surface 40 except for two spout openings 42 and 44. A peripherally connecting flange 46 surrounds a peripheral edge 48 of the circular wall 38 and is receivable on the connecting bead 24 so that the circular wall 38 closes the container upper end 16. Particularly, the connecting flange 46 includes a downwardly open U-shaped upper portion 50 receivable on the connecting bead upper end 32 and a diagonal wall portion 52 for resting on the connecting ring diagonal portion 34.

A first cylindrical reinforcement rib 54 depends downwardly from the circular wall 38 at the edge 48. The reinforcement rib 54 has an outer diameter slightly less than the inner diameter of the connecting ring inner surface 36. The height of the rib 54 is selected so that its lower distal edge is approximately flush with that of the connecting ring 24. As a result, the rib 54 supports the bead 24 in the event the container 10 is tipped. A second cylindrical reinforcement rib 56 depends downwardly from the central wall 38 and has a diameter less than the diameter of the first rib 54. The ribs 54 and 56 are coaxial and are of different heights. Particularly, the first rib 54 has a greater height than the second rib 56, as particularly illustrated in FIGS. 2 and 3.

An upper cylindrical rib 58 is provided at the edge 48 immediately above the first reinforcement rib 54. The rib 58 is used for stacking multiple containers as providing a ledge upon which another container may rest so that it does not sit directly on the central wall 38.

The use of the flat surface 40 on the circular wall 30 results in the closure 22 being kept generally clean as by eliminating crevices in which debris or liquids may collect. Further, the reinforcement ribs 54 and 56 provide required reinforcement as specified by various standards organizations for shipping of goods by motor freight. Also, the reinforcement ribs 54 and 56 and their coaction with the connecting ring 24 provides improved impact resistance while facilitating stacking as with use of the upper rib 58.

To secure the closure 22 to the connecting ring 24 a C-shaped locking band 60 extends around the closure flange 46 and connecting ring 24 as illustrated. Particularly, one leg of the locking band 60 is positioned above the flange upper portion 50 while the other leg of the band is received in the annular recess 30. A suitable locking element 62 pulls ends of the bands 60 together to lock the closure 22 on the container connecting ring 24.

In the illustrated embodiment of the invention, the side wall 12 is a fibrous side wall and the connecting ring 24 is of molded plastic construction. Alternatively, the connecting ring 24 could be a metal connecting ring as is conventional. Alternatively, the drum 10 could be a unitary molded plastic drum with the connecting ring 24 integrally molded therewith. In fact, the closure 22 could be used with any such drum and could also be a self-locking cover including suitable means for directly locking with the annular recess 30, as is well known.

The disclosed embodiment is illustrative of the broad inventive concepts comprehended hereby.

I claim:

1. A closure for use with a tubular container having an open end with a cylindrical connecting bead at said open end, said connecting bead being relatively narrow at a distal top portion and widening at an angled portion to an inner portion having an inner cylindrical wall of a select diameter, said closure comprising:

a planar circular wall defining a flat upper surface having a peripheral edge, a peripheral connecting flange surrounding and connected to said wall at said edge, said connecting flange comprising a diagonal wall section extending upwardly from said circular wall and connected to a downwardly opening U-shaped portion, a first cylindrical reinforcement rib extending downwardly from said circular wall at said edge and having an outer diameter slightly less than the select diameter of the connecting bead inner cylindrical wall, and a second cylindrical reinforcement rib depending downwardly from said circular wall and having a diameter less than the diameter of said first cylindrical reinforcement rib, so that, in use, said U-shaped portion is received on said connecting bead narrow portion and said circular wall closes the open end of the container and said first cylindrical rib is in direct engagement with the connecting bead cylindrical wall to reinforce the connecting bead.

2. The closure of claim 1 wherein said first and second reinforcement ribs are coaxial.

3. The closure of claim 1 wherein said first and second reinforcement ribs are of different heights.

4. The closure of claim 1 wherein said first reinforcement rib has a greater height than said second reinforcement rib.

5. The closure of claim 1 wherein said first rib has a distal edge flush with a distal edge of the connecting bead.

6. A closure for use with a tubular container having an open end with a cylindrical connecting ring at said open end, said connecting ring being relatively narrow at a distal top portion and widening at an angled portion to an inner portion having an inner cylindrical wall of a select diameter, said closure comprising:

a unitary wall element of molded synthetic resin and having a planar central circular wall defining a flat upper surface having a peripheral edge, a peripheral connecting flange surrounding and connected to said wall at said edge, said connecting flange comprising a diagonal wall section extending upwardly from said circular wall and connected to a downwardly opening U-shaped portion, a first cylindrical reinforcement rib extending downwardly from said circular wall at said edge and having an outer diameter slightly less than the select diameter of the connecting ring inner cylindrical wall, and a second cylindrical reinforcement rib depending downwardly from said circular wall and having a diameter less than the diameter of said first cylindrical reinforcement rib, so that, in use, said U-shaped portion is received on said connecting ring narrow portion and said circular wall closes the open end of the container and said first cylindrical rib is in direct engagement with the connecting ring cylindrical wall to reinforce the connecting ring.

7. The closure of claim 6 wherein said first and second reinforcement ribs are coaxial.

8. The closure of claim 6 wherein said first and second reinforcement ribs are of different heights.

9. The closure of claim 6 wherein said first reinforcement rib has a greater height than said second reinforcement rib.

10. The closure of claim 6 further comprising an upper cylindrical rib extending upwardly from said circular wall at said peripheral edge providing a ledge for supporting another tubular container.

11. The closure of claim 10 wherein said upper cylindrical rib is immediately above the first reinforcement rib.

12. The closure of claim 6 wherein said first rib has a distal edge flush with a distal edge of the connecting ring.

13. A closure for use with a tubular container having an open end with a cylindrical connecting ring at said open end, said closure comprising:

a unitary wall element of molded synthetic resin and having a planar central circular wall defining a flat upper surface, a peripheral connecting flange surrounding a peripheral edge of said circular wall and receivable on the connecting ring so that, in use, said circular wall closes the open end of the container, a first cylindrical reinforcement rib depending downwardly from said circular wall and having a diameter less than a diameter of the connecting ring, and a second cylindrical reinforcement rib depending downwardly from said circular wall and having a diameter less than the diameter of said first cylindrical reinforcement rib and an upper cylindrical rib extending upwardly from said circular wall at said peripheral edge providing a ledge for supporting another tubular container.

14. The closure of claim 13 wherein said upper cylindrical rib is immediately above the first reinforcement rib.

* * * * *